US009372466B2

(12) United States Patent
Zona et al.

(10) Patent No.: US 9,372,466 B2
(45) Date of Patent: Jun. 21, 2016

(54) CLEANING BLADE LUBRICANT HAVING HIGH ASPECT RATIO

(71) Applicant: XEROX CORPORATION, Norwalk, CT (US)

(72) Inventors: Michael F Zona, Holley, NY (US); Juan A Morales-Tirado, Henrietta, NY (US); Samir Kumar, Pittsford, NY (US)

(73) Assignee: XEROX CORPORATION, Norwalk, CT (US)

( * ) Notice: Subject to any disclaimer, the term of this patent is extended or adjusted under 35 U.S.C. 154(b) by 227 days.

(21) Appl. No.: 13/912,537

(22) Filed: Jun. 7, 2013

(65) Prior Publication Data

US 2014/0363212 A1 Dec. 11, 2014

(51) Int. Cl.
*G03G 21/00* (2006.01)
*C10M 107/00* (2006.01)

(52) U.S. Cl.
CPC ..... *G03G 21/0011* (2013.01); *C10M 7/00* (2013.01); *G03G 21/0017* (2013.01)

(58) Field of Classification Search
CPC ..... G03G 21/0011; G03G 21/0017
USPC ..... 399/346, 350
See application file for complete search history.

(56) References Cited

U.S. PATENT DOCUMENTS

| | | | | |
|---|---|---|---|---|
| 4,252,658 | A * | 2/1981 | Tasaka et al. | 508/131 |
| 5,646,718 | A * | 7/1997 | Suwa et al. | 399/350 |
| 6,060,205 | A * | 5/2000 | Takeichi et al. | 430/126.2 |
| 6,340,549 | B1 * | 1/2002 | Maehata et al. | 430/111.4 |
| 6,534,230 | B1 | 3/2003 | Blair et al. | |
| 2011/0240406 | A1 * | 10/2011 | Zona | F16N 7/12 184/64 |

* cited by examiner

*Primary Examiner* — David Gray
*Assistant Examiner* — Andrew V Do
(74) *Attorney, Agent, or Firm* — Shimokaji IP

(57) ABSTRACT

A cleaning blade lubricant including an acicular shape lubricant is provided. The cleaning blade lubricant is applied to a cleaning blade of an electrophotographic printing device for improving the cleaning performance of a cleaning blade of an electrophotographic printing device.

9 Claims, 5 Drawing Sheets

| TiO2 TYPE | VENDOR | SPECIFIC GRAVITY | SPECIFIC SURFACE AREA M^2/g | LONG AXIS (nm) | SHORT AXIS (nm) | ASPECT RATIO | SURFACE TREATMENT | POWDER RESISTIVITY (ohm*cm) | TESTED IN TONER FORMULATION |
|---|---|---|---|---|---|---|---|---|---|
| FTL-1000 | ISHIHARA SANGYO KAISHA | 4.2 | ---- | 3000 - 6000 | 50 - 100 | 30 - 120 | Sb doped SnO2 | 1.00E+01 | |
| TTO-S-1 | ISHIHARA SANGYO KAISHA | 4.2 | 90 - 110 | 50 - 100 | 10 - 20 | 2.5 - 10 | ZrO2 / Al(OH)3 | --- | |
| TTO-S-2 | ISHIHARA SANGYO KAISHA | 4.2 | 55 - 80 | 50 - 100 | 10 - 20 | 2.5 - 10 | ZrO2 / Al(OH)3 / | --- | |
| TTO-S-3 | ISHIHARA SANGYO KAISHA | 4.2 | 85 - 105 | 50 - 100 | 10 - 20 | 2.5 - 10 | Al(OH)3 | --- | |
| TTO-S-4 | ISHIHARA SANGYO KAISHA | 4.2 | 52 - 72 | 50 - 100 | 10 - 20 | 2.5 - 10 | Al(OH)3 / Stearic | --- | |
| MPT-136 | ISHIHARA SANGYO KAISHA | 4.2 | 40 - 60 | 50 - 100 | 10 - 20 | 2.5 - 10 | Al(OH)3 / Stearic | --- | |
| TTO-V-3 | ISHIHARA SANGYO KAISHA | 4.2 | 120 - 150 | 30 - 90 | 5 - 15 | 2 - 18 | Al(OH)3 | --- | |
| TTO-V-4 | ISHIHARA SANGYO KAISHA | 4.2 | 60 - 80 | 30 - 90 | 5 - 15 | 2 - 18 | Al(OH)3 / Stearic Acid | --- | |
| FTL-300 | ISHIHARA SANGYO KAISHA | 4.2 | 5 - 7 | 5150 | 270 | 19 | Sb doped SnO2 | --- | |
| FTL-200 | ISHIHARA SANGYO KAISHA | 4.2 | 7 - 10 | 2660 | 210 | 14 | Sb doped SnO2 | --- | |
| FTL-100 | ISHIHARA SANGYO KAISHA | 4.2 | 10 - 15 | 1680 | 130 | 13 | Sb doped SnO2 | --- | X |
| FTL-110 | ISHIHARA SANGYO KAISHA | 4.2 | 10 - 20 | 1660 | 130 | 13 | Sb doped SnO2 | --- | |

FIG. 3

| Rice Shaped | Stick Shaped | Butterfly Shaped | Bow Tie Shaped |
|---|---|---|---|
| 20nm x 100 nm | 8nm x 100 nm | 30nm x 130 nm | 30nm x 100nm |
| 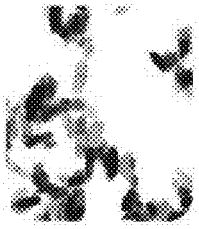 | 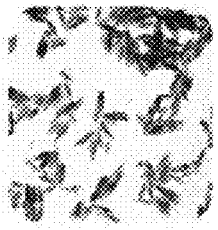 | 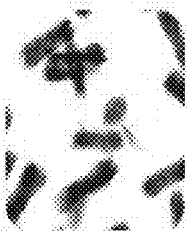 | 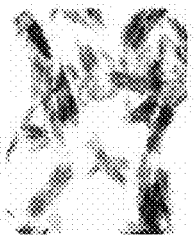 |
FIG. 5
| 0.13 μm x 1.68 μm | 0.21 μm x 2.86 μm | 0.27 μm x 5.15 μm |
|---|---|---|
| 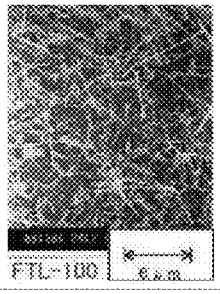  | 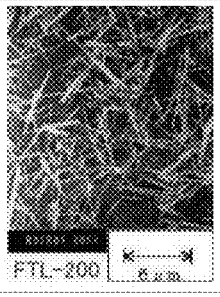  | 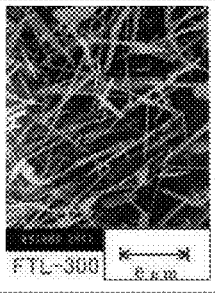  |
FIG. 6

CLEANING BLADE LUBRICANT HAVING HIGH ASPECT RATIO

TECHNICAL FIELD

This disclosure is generally directed to a cleaning blade of an electrophotographic printing device. More specifically, this disclosure is directed to a cleaning blade lubricant having a high aspect ratio that improves toner cleaning performance against a photoreceptor of an electrophotographic printing device.

BACKGROUND

Copiers and printers containing photoconductors create a latent image which is developed by using toner. The toner on the photoconductor then transfers to paper or appropriate intermediate which then travels through a heater which fixes the toner particles on the paper. The transfer of toner particles from the photoconductor to the paper or intermediate is not 100% complete. There are residual toner particles on the photoconductor that need to be removed. It is common to remove the remaining toner particles on the photoconductor after each transfer process by using a cleaning device, such as a cleaning blade.

Non-magnetic single component development (SCD) toner requires high flowability and high chargeability because the time for toner to flow through the contacting nip formed between the charge blade and the development roll is very short. Low charge causes reduced solid area development, increased toner dusting in white areas of the page (background), poor development stability over time, ghosting, and/or white bands.

For good cleaning performance of any un-transferred toner, the forces acting near the cleaning blade are such that there is sufficient force against the photoreceptor to prevent toner from getting underneath, but not so much force to damage the cleaning blade edge during operation and continued print cycles. Cleaning performance degrades when the edge of the blade wears, the photoreceptor surface becomes damaged, or the urethane properties become unstable over time. Cleaning performance may also degrade when the toner particles are spherical and thereby tend to roll under the cleaning blade nip.

Cleaning performance may be improved by adding acicular surface additives, for example, acicular titanium dioxide, during the blending of the toner particles. The acicular surface additive is not blended into the toner particles, but rather mixed in and loosely dispersed among the toner particles.

In addition, cleaning performance may be improved by lubricating the cleaning blade with various lubricating powders, for example, zinc stearate and graphite fluoride, to reduce surface forces on the cleaning blade. Lubrication can be achieved by dusting the cleaning blade with powders or coating the cleaning blade with a solution including the lubricating powders. Unfortunately, these lubricant powders do not remain adhered to the cleaning blade and create frictional forces that damage the blade edge, which inherently causes toner to get under the blade and create image defects.

There remains a need for a cleaning blade and lubricant for an electrophotographic printing device that minimizes toner particles from rolling underneath the cleaning blade, particularly spherical shaped toner particles.

SUMMARY

The following detailed description is of the best currently contemplated modes of carrying out exemplary embodiments herein. The description is not to be taken in a limiting sense, but is made merely for the purpose of illustrating the general principles of the present disclosure, since the scope of the present disclosure is best defined by the appended claims.

Various inventive features are described below that can each be used independently of one another or in combination with other features.

Broadly, embodiments of the present disclosure generally provide a cleaning blade lubricant comprising an acicular shaped lubricant.

In another aspect of the present disclosure, a cleaning blade for toner particles includes a surface and an acicular shaped lubricant on the surface.

In yet another aspect of the present disclosure, a method for improving the performance of a cleaning blade of an electrophotographic printing device includes the step of applying an acicular shaped lubricant to the cleaning blade.

BRIEF DESCRIPTION OF THE FIGURES

Various embodiments of the present disclosure will be described herein below with reference to the following figures wherein:

FIG. 3 shows properties of the different acicular $TiO_2$ used as acicular shaped lubricant according to the present disclosure.

FIG. 5 depicts different shapes of acicular TiO2 according to embodiments of the present disclosure.

FIG. 6 depicts different shapes of acicular TiO2 according to yet other embodiments of the present disclosure.

DETAILED DESCRIPTION

The present disclosure provides a cleaning blade and lubricant suitable for use, for example, on a cleaning blade of an electrophotographic device and which lubricant reduces the probability of toner particles rolling on the photoconductor drum surface and underneath the cleaning blade.

Figure 1:
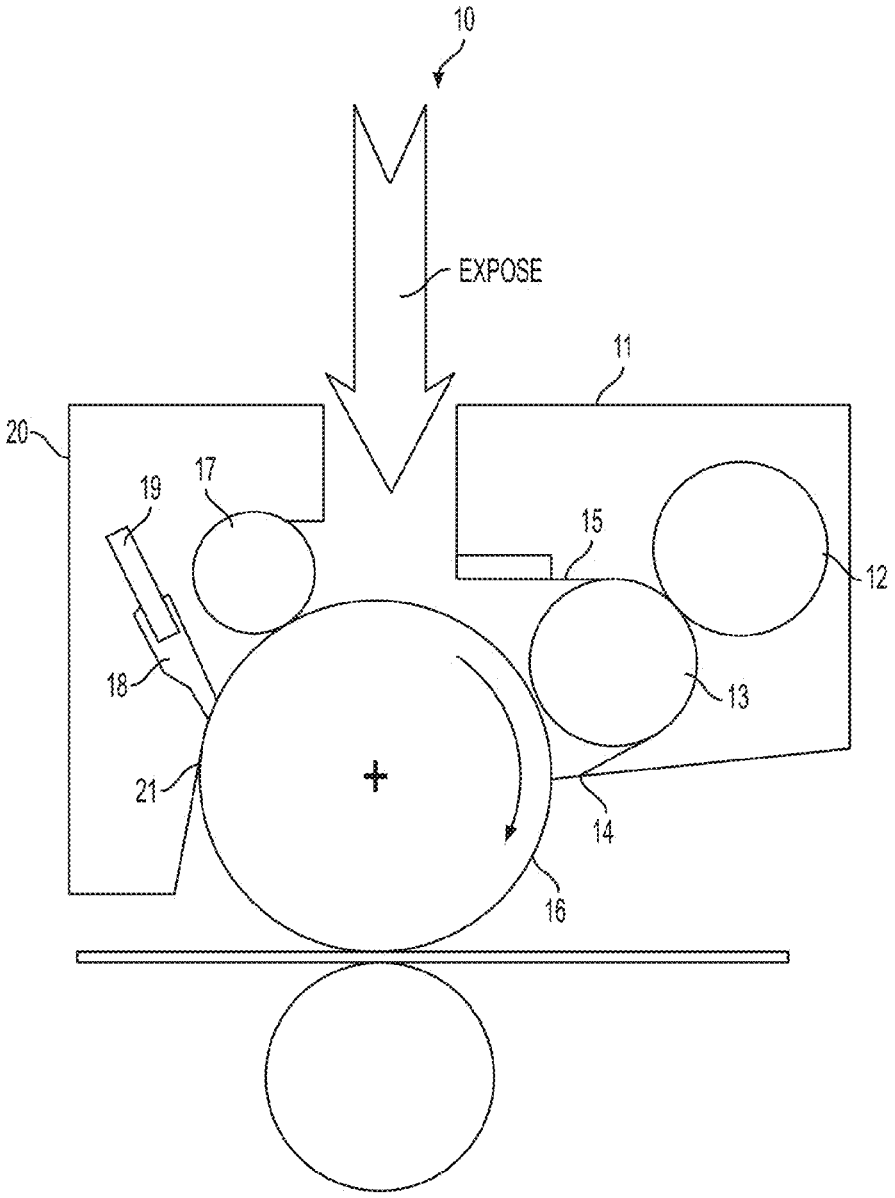
FIG. 1 is a diagram of a non-magnetic single component development architecture having a cleaning blade according to an embodiment of the present disclosure.

FIG. 1 shows a printing system 10 according to an embodiment, such as a non-magnetic, single component development system. Toner (not shown) is put into a cartridge sump 11. A paddle (not shown) or gravity can be used to load the toner to a supply roller 12. The toner may then transfer to a development roll 13. As the development roll 13 rotates, the toner can be metered to the nip 14 of the charge blade 15. A photoconductor drum 16 may be located in contact with the development roll 13 that may be connected to a voltage source 17. A cleaning blade 18, which may include a urethane or silicone rubber blade mounted onto a rigid holder 19, is attached to a cartridge housing 20. The physical characteristics and dimensions of the cleaning blade 18, for example, modulus, thickness, and length may depend on the size of the photoconductor drum 16. The forces created at the nip 21 formed between the cleaning blade 18 and the photoconductor drum 16 should prevent residual toner from getting under the cleaning blade 18 and contaminating the voltage source 17. The toner should be able to charge and flow well in the nip created between the charge blade 15 and the development roll 13 to enable sufficiently charged developed mass on the photoconductor drum 16 when brought into contact with a latent image.

Figure 2:
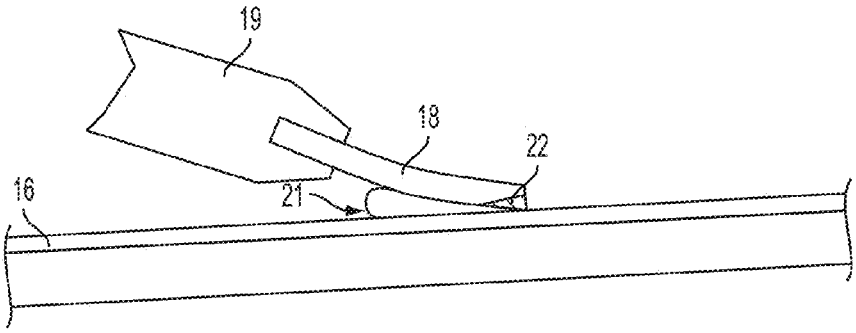
FIG. 2 shows a cleaning blade with an acicular shaped lubricant thereon according to an embodiment of the present disclosure.

To reduce surface forces and to improve residual toner cleaning off the photoreceptor, in an embodiment according to the present disclosure shown by FIG. 2, an acicular shaped lubricant 22 may be applied to the surface of the cleaning blade 18. Acicular shaped lubricant(s) may enhance the ability of the cleaning blade to prevent toner from getting under the blade edge and creating print quality defects. The acicular shaped lubricant may operate by separating the toner particles from the photoreceptor surface 16 at the cleaning blade 18 edge. The separation can occur when the long axes of the particles of the acicular shaped lubricant are substantially parallel or diagonal to the surface of the cleaning blade, enabling the toner particle to slide on, rather than under, the cleaning blade.

An acicular shape lubricant according to embodiments herein may also reduce the incidence of cleaning blade clogging and print defects compared with conventional cleaning blade lubricants, such as zinc stearate and graphite fluoride. In addition, the acicular shaped lubricant according to embodiments herein may reduce the tendency of the toner particles to roll under the cleaning blade.

The amount of acicular shaped lubricant applied to the cleaning blade may depend on the size and shape of the cleaning blade. The acicular shaped lubricant may be sufficient to completely cover the working edge of the cleaning blade prior to installing it against the photoreceptor.

In embodiments herein, the term "acicular" may refer to particles having irregular, slender, or a needle-like shape. Thus, the acicular shaped lubricant may be, for example, rice shaped, stick shaped, butterfly shaped, or bow tie shaped.

The particles of acicular shaped lubricant may be in length, for example, from about 0.25 to about 8.0 microns, or from about 0.5 to about 5.0 microns, or from about 1.0 to 3.0. The acicular shaped lubricant particles may have an aspect ratio (length/diameter), such as from about 4 to about 25, or from about 8 to about 18, or from about 10 to about 15.

In exemplary embodiments, the acicular shaped lubricant may be, for example, acicular carbon fiber, acicular fiber glass, acicular carbon nanotubes, and acicular magnesium fiber. In an exemplary embodiment, acicular titanium dioxide (acicular $TiO_2$) may be the acicular shaped lubricant, though there may be more than one acicular surface additive used.

The acicular $TiO_2$, may be, for example, acicular $TiO_2$ sold by Titan Kogyo or Sangyo Kaisha, that comes in different shapes as shown in FIG. 5.

Similar materials are supplied by Sangyo Kaisha. These materials have a stick like shape, but are larger than those offered by Titan Kogyo, as shown in FIG. 6.

FIG. 3 shows the properties of the different acicular $TiO_2$ used as acicular shaped lubricant on the present disclosure. As can be seen from FIG. 3, the long axis of the acicular shaped lubricant particle is significantly greater than the short axis thereof.

Figure 4:
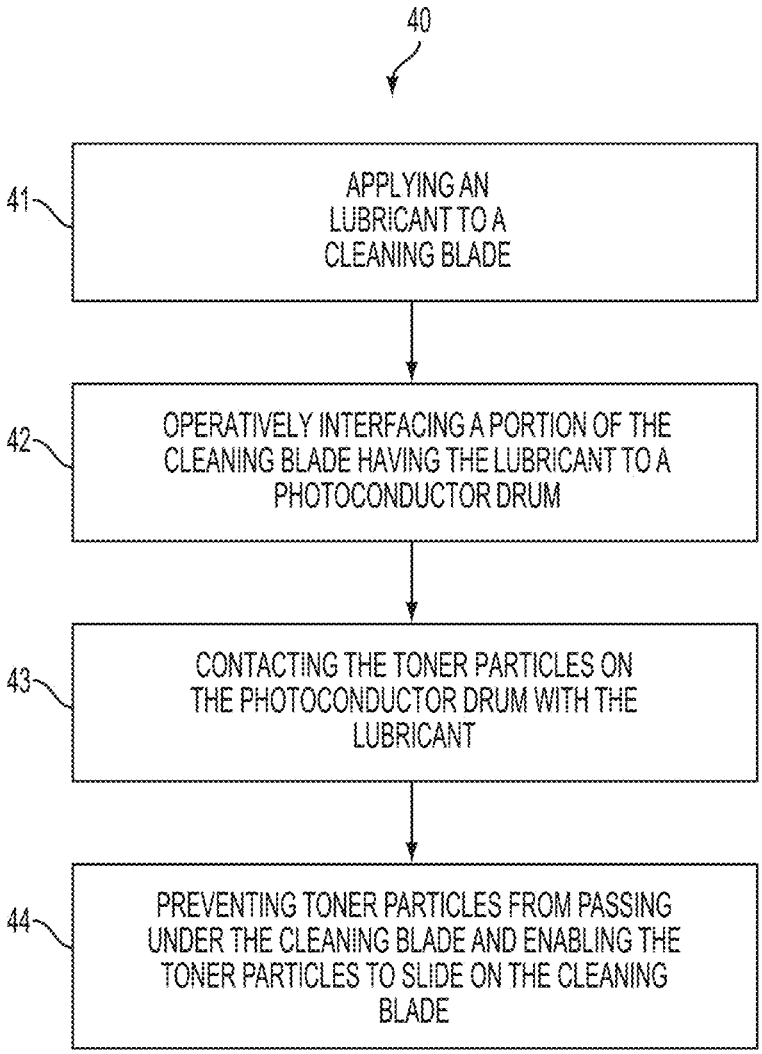
FIG. 4 is a flowchart of a method for improving the performance of a cleaning blade of an electrophotographic printing device according to an embodiment of the present disclosure.

FIG. 4 is a flowchart of a method 40 for improving the performance of a cleaning blade of an electrophotographic printing device according to an embodiment of the present disclosure.

In a step 41, an acicular shaped lubricant can be applied to a cleaning blade. In exemplary embodiments, the acicular shaped lubricant may be, for example, those described above, though there may be more than one acicular surface additive used.

In exemplary embodiments, the acicular shaped lubricant can be applied to the cleaning blade by dusting the cleaning blade with the acicular lubricant prior to assembly in a cartridge. For example, a brush can be used to dust or brush the acicular shaped lubricant onto the cleaning blade edge that interfaces the photoconductor drum. As a further example, the blade edge may be dipped into a pile of dry acicular shaped lubricant to fully coat the blade edge.

In some embodiments, a solution including an acicular shaped lubricant can be employed. In such embodiments, the acicular shaped lubricant may be suspended in a solvent or alcohol based liquid and then applied to the cleaning blade by a syringe or a dropper. In other embodiments, the cleaning blade may be coated or dipped into a solution including the acicular shaped lubricant.

The aqueous or alcohol based liquid may be, for example, iso-propyl alcohol (IPA); engineered fluid Novec™ by 3M such as HFE7100, HFE7200, HFE7300 or performance fluid such as PF5060 by 3M.

The amount of acicular shaped lubricant in the alcohol based liquid may be, for example, from about 10 to about 40 parts by weight of the alcohol based liquid to about 1 part by weight of acicular shaped lubricant, or from about 12 to about 35 parts by weight of the alcohol based liquid to about 1 part by weight of acicular shaped lubricant, or from about 18 to about 25 parts by weight of the alcohol based liquid to about 1 part by weight of acicular shaped lubricant.

In a step 42, a portion (such as the edge or surface) of the cleaning blade having the acicular shaped lubricant can be operatively interfaced to the photoconductor drum, such as shown in FIG. 2. For example, the foregoing portion (such as the edge or surface) of the cleaning blade can be placed in relation to the photoconductor drum to create a nip therebetween where toner particles may reside and be adjacent to the foregoing portion.

In a step 43, the foregoing portion (such as the edge or surface) of the cleaning blade having the acicular shaped lubricant can contact toner particles on the photoconductor drum.

In a step 44, toner particles contacted by the acicular shaped lubricant are prevented from passing under the cleaning blade and enabled to slide on the cleaning blade.

In view of the above, it was surprisingly discovered that the sole presence of an acicular surface lubricant on the cleaning blade helped to form a more robust dam in the cleaning blade nip that, in turn, prevents toner and larger additives from rolling under the cleaning blade, enabling a good cleaning performance.

Using an acicular shaped lubricant directly on the cleaning blade also allows the use of spherical toner particles, which are more stable and easier to manufacture than non-spherical toner particles. Additionally, enabling the cleaning of spherical particles improves the overall quality of the toner.

In addition, using an acicular shaped lubricant on the cleaning blade optimizes cleaning performance, instead of redesigning the cleaning blade or introducing an acicular shaped surface additive to the toner particle itself.

Furthermore, using an acicular shaped lubricant on the cleaning blade can be very cost effective, as it does not require adding an acicular titania additive to the toner which causes Bias Charge Roller (BCR) contamination due to excessively loose additives.

It will be appreciated that variations of the above-disclosed and other features and functions, or alternatives thereof, may be desirably combined into many other different systems or applications. Also that various, presently unforeseen or unanticipated, alternatives, modifications, variations or improvements therein may be subsequently made by those skilled in the art which are also intended to be encompassed by the following claims.

What is claimed is:

1. A cleaning blade for toner particles, comprising:

a blade edge;

a lubricant solution on and along an entire length of the blade edge, wherein the lubricant solution consists of an alcohol and an acicular material that is selected from the group consisting of acicular carbon fiber, acicular fiber glass, acicular carbon nanotubes, and acicular magnesium fiber;

wherein the acicular shaped material has an aspect ratio (length/diameter) from about 4 to about 25, and wherein the acicular shaped material has a length from about 0.25 to about 8.0 microns.

2. The lubricant solution according to claim 1, wherein the acicular shaped material has a length from about 0.5 to about 5.0 microns.

3. The lubricant solution according to claim 1, wherein the acicular shaped material has a length from about 1.0 to about 3.0 microns.

4. A method for improving the performance of a cleaning blade of an electrophotographic printing device, comprising the step of:

applying a lubricant solution, that consists of an alcohol and an acicular shaped material, completely over a working edge of the cleaning blade;

wherein the acicular shaped material is selected from the group consisting of acicular carbon fiber, acicular fiber glass, acicular carbon nanotubes, and acicular magnesium fiber; and wherein a ratio of alcohol to acicular material is from about 18 to about 25 parts by weight to about 1 part by weight.

5. The method according to claim 4, further comprising the step of operatively interfacing a portion of the cleaning blade having the acicular shaped material to a photoconductor drum.

6. The method according to claim 4, further comprising the step of contacting the toner particles on the photoconductor drum with the acicular shaped material.

7. The method according to claim 4, further comprising the step preventing toner particles from passing under the cleaning blade.

8. The method according to claim 4, further comprising the step enabling toner particles to slide on the cleaning blade.

9. The method according to claim 4, further comprising the step of creating a nip where toner particles are adjacent the edge of the cleaning blade.

* * * * *